US009661895B2

(12) United States Patent
Hohmann

(10) Patent No.: US 9,661,895 B2
(45) **Date of Patent: *May 30, 2017**

(54) NOZZLE SHOE

(71) Applicant: Paul E. Hohmann, Taylors, SC (US)

(72) Inventor: Paul E. Hohmann, Taylors, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/929,306

(22) Filed: Oct. 31, 2015

(65) Prior Publication Data

US 2016/0051005 A1 Feb. 25, 2016

Related U.S. Application Data

(63) Continuation-in-part of application No. 14/106,797, filed on Dec. 15, 2013, now Pat. No. 9,204,684.

(51) Int. Cl.

| | |
|---|---|
| ***A63B 31/11*** | (2006.01) |
| ***A43B 5/08*** | (2006.01) |
| ***B63H 16/08*** | (2006.01) |

(52) U.S. Cl.

CPC ..... *A43B 5/08* (2013.01); *B63H 16/08* (2013.01)

(58) Field of Classification Search

CPC A43B 5/08; A63B 31/08; A63B 31/11; A63B 31/14; A63B 2031/112; A63B 2031/115; A63B 2031/117; B63H 16/00; B63B 35/83

USPC ..... 441/55, 60, 61, 64

See application file for complete search history.

(56) References Cited

U.S. PATENT DOCUMENTS

| | | | | |
|---|---|---|---|---|
| 2,889,563 | A * | 6/1959 | Lamb | A63B 31/11 441/64 |
| 5,387,145 | A * | 2/1995 | Wagner | A63B 31/11 441/64 |
| 6,053,788 | A * | 4/2000 | Garofalo | A63B 31/11 441/64 |
| 7,736,208 | B2 | 6/2010 | Bonis et al. | |
| 7,753,749 | B2 * | 7/2010 | Mun | A63B 31/11 441/64 |
| 7,997,948 | B2 | 8/2011 | Fraser et al. | |

* cited by examiner

*Primary Examiner* — Daniel V Venne
(74) *Attorney, Agent, or Firm* — Christopher J. Pfister

(57) ABSTRACT

A shoe includes one or more nozzles mounted to the shoe, each of the one or more nozzles including one or more inlets to take in fluid traveling in an intake direction during a kicking motion of a wearer, a bend to change a flow direction of the fluid from the intake direction to an output direction, and one or more outlets to expel fluid in the output direction.

15 Claims, 14 Drawing Sheets

OUTSTEP OF SHOE
WITH INTERNAL
DIRECTIONAL VANES
SHOWN

NOZZLE SHOE

CROSS-REFERENCE TO RELATED APPLICATIONS

This application claims priority from and is a continuation-in-part of U.S. application Ser. No. 14/106,797 to Paul E. Hohmann, filed Dec. 15, 2013, the disclosure of which is incorporated herein by reference in its entirety.

BACKGROUND OF THE INVENTION

The present general inventive concept relates to a nozzle shoe. More particularly, the present general inventive concept relates to a nozzle shoe configured for use in the water without fins.

Currently the most efficient method of propelling a person through the water is with the use of swim fins attached to the wearer's feet. The current design of swim fins, aside from slight alterations to the geometry and composition materials, has remained relatively unchanged since its invention.

Although the conventional design of swim fins can provide forward thrust when swimming, such swim fins prove to be quite cumbersome or even dangerous to wear when out of the water. They are difficult to wear while walking on dry land and prove to be challenging to tread water in. Accordingly, a shoe is required which is efficient and effective both in and out of the water.

SUMMARY OF THE INVENTION

Features and utilities of the present general inventive concept provide a nozzle shoe adapted for use in the water without the use of fins.

Additional features and utilities of the present general inventive concept will be set forth in part in the description which follows and, in part, will be obvious from the description, or may be learned by practice of the general inventive concept.

Exemplary embodiments of the present general inventive concept provide a shoe including one or more nozzles mounted to the shoe, each of the one or more nozzles including one or more inlets to take in fluid traveling in an intake direction during a kicking motion of a wearer, a bend to change a flow direction of the fluid from the intake direction to an output direction, and an outlet to expel fluid in the output direction.

One or more of the nozzles may further include at least one internal vane comprising a bend to change a flow direction of the fluid from the intake direction to the output direction.

A direction of the at least one internal vane may be preset according to the kicking motion.

The outlet may have a smaller area than the one or more inlets.

The at least one internal vane may maintain the fluid in a substantially laminar condition as the fluid is moved from the inlet to the outlet.

At least one of the one or more nozzles may be mounted on a first side of the shoe, and at least one of the one or more nozzles may be mounted on a second side of the shoe opposite the first side.

The one or more inlets of the at least one nozzle mounted on the first side of the shoe may be oriented in a first direction, and the one or more inlets of the at least one nozzle mounted on the second side of the shoe may be oriented in a second direction different from the first direction.

The inlets of the nozzles mounted on the first and second sides of the shoe may be oriented in the same direction.

The first direction and the second direction may be opposite to each other.

The shoe may further include a sole. The one or more inlets may face towards the sole.

The shoe may further include a sole. The one or more inlets may face away from the sole.

The one or more nozzles may be mounted at an ankle portion of the shoe, the ankle portion corresponding to a location of the wearer's ankle.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
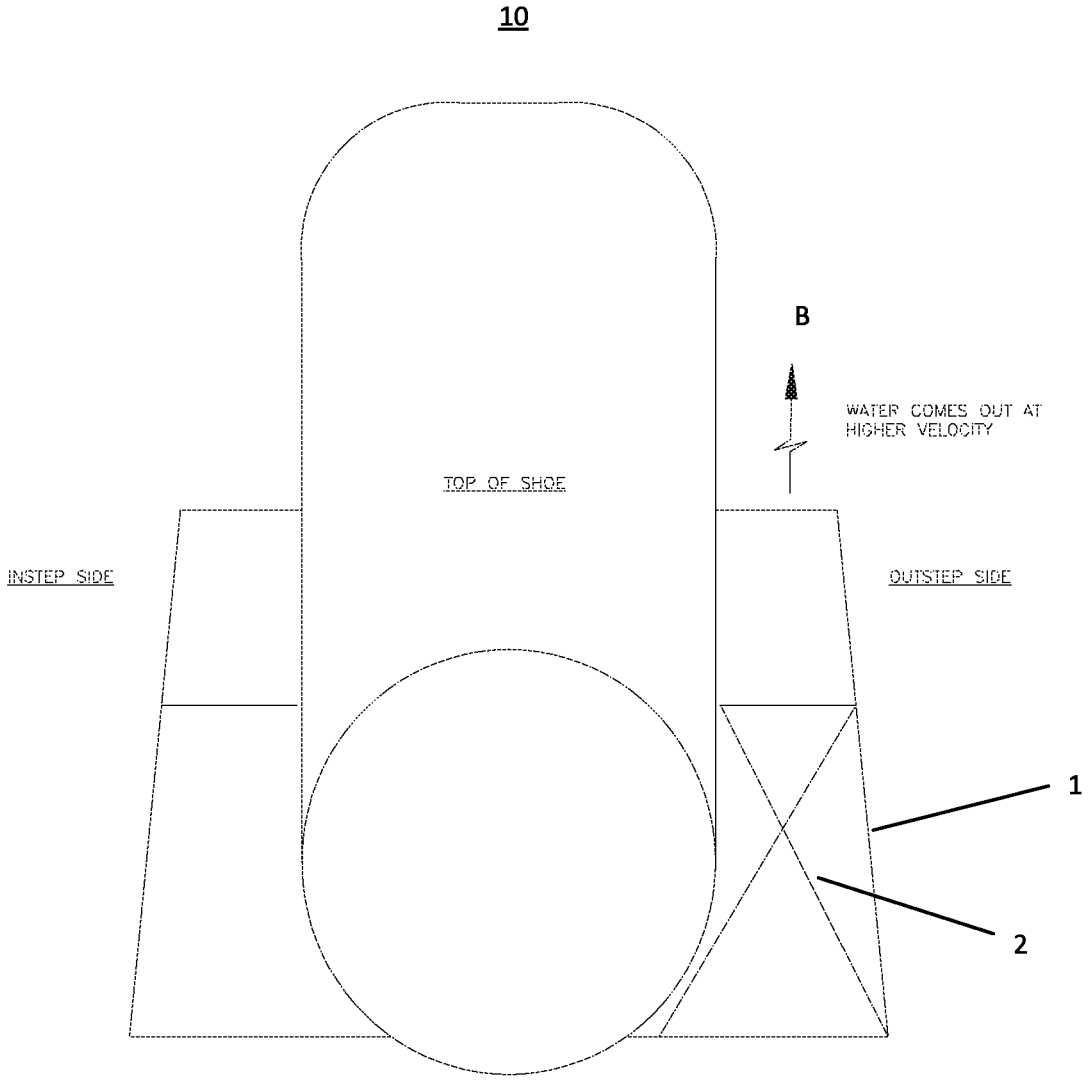
FIG. 1 is a top view illustrating a nozzle shoe according to an exemplary embodiment of the present general inventive concept.
Figure 2:
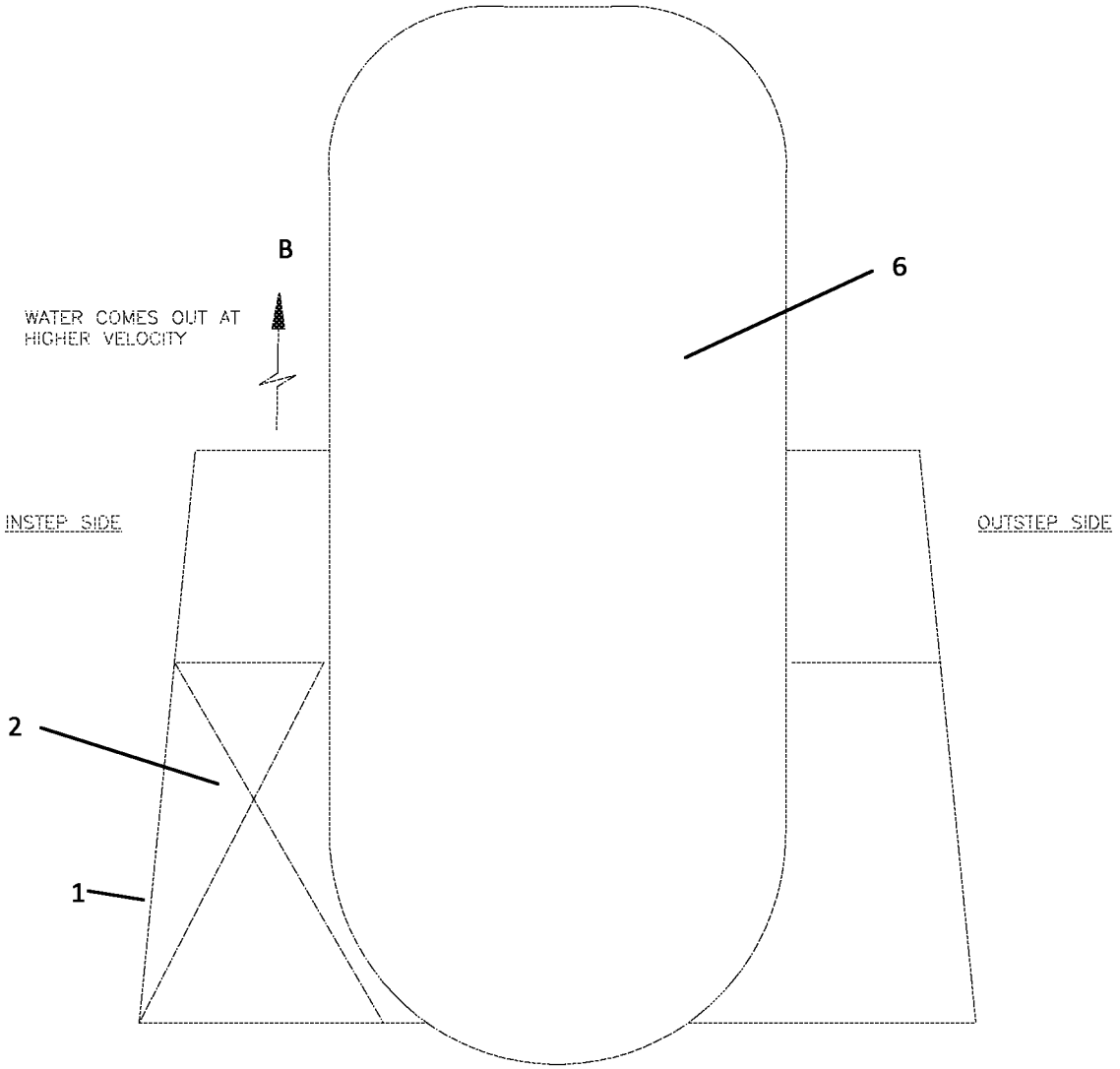
FIG. 2 is a bottom view illustrating a nozzle shoe according to an exemplary embodiment of the present general inventive concept.
Figure 3:
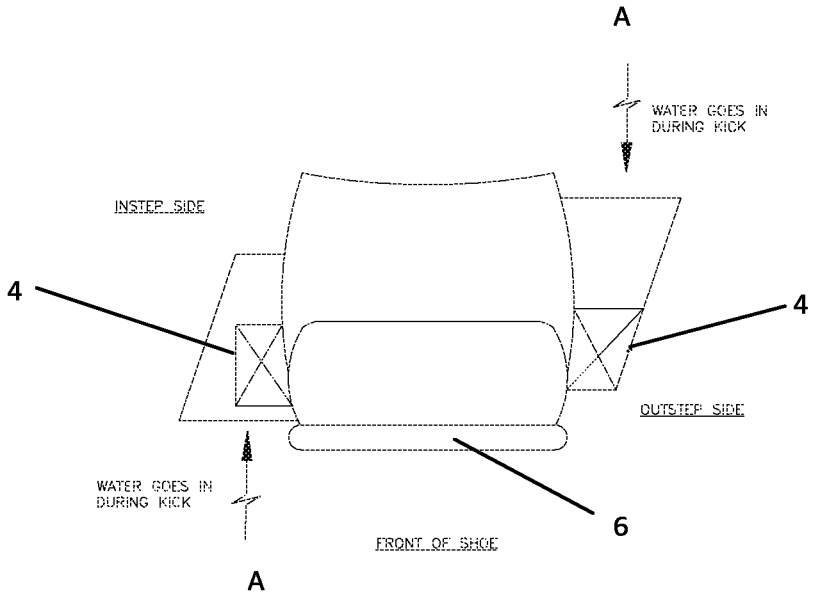
FIG. 3 is a front view illustrating a nozzle shoe according to an exemplary embodiment of the present general inventive concept.
Figure 4:
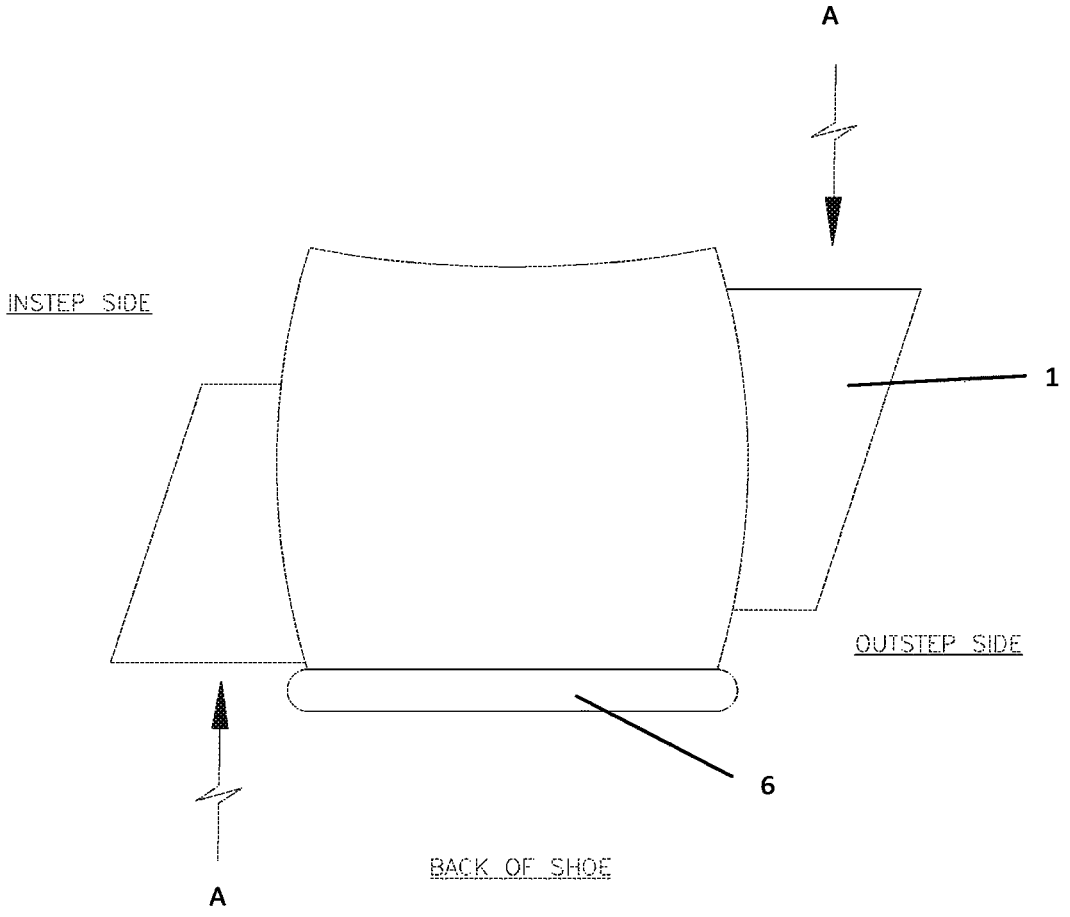
FIG. 4 is a rear view illustrating a nozzle shoe according to an exemplary embodiment of the present general inventive concept.

Reference will now be made in detail to the embodiments of the present general inventive concept, examples of which are illustrated in the accompanying drawings, wherein like reference numerals refer to like elements throughout. The embodiments are described below to explain the present general inventive concept by referring to the figures.

As used herein, directional language such as "up," "down," "left," "right," "forward," "backward," and so on, as well as language such as a "first" or "second" component, are used for convenience and to describe the relative location and orientation of elements, with reference to the accompanying Figures. It will be understood that such terms are not intended to be limiting. For example, an element described as the "second" could be the "first," depending on the particular embodiment of the present general inventive concept.

FIGS. 1-14 illustrate exemplary embodiments of a nozzle shoe 10 according to the present general inventive concept. These Figures are not necessarily drawn to scale.

A nozzle shoe 10 according to an exemplary embodiment of the present general inventive concept is a shoe designed for beach/water wear. The shoe 10 may be worn comfortably, for example on the beach, with a reduced hazard of tripping or falling as compared to a conventional shoe with swim fins, and still transfer directly into a functional mode in the water to help propel the wearer during a kicking motion.

An exemplary embodiment of a nozzle shoe 10 according to the present general inventive concept is illustrated in FIG. 1. The nozzle shoe 10 includes one or more nozzles 1, which are attached to the shoe 10 in locations where the nozzles 1 can direct a flow of fluid, e.g, water. In the exemplary embodiment illustrated in FIG. 1, two nozzles 1 are mounted on opposing sides of the nozzle shoe 10.

Figure 5:
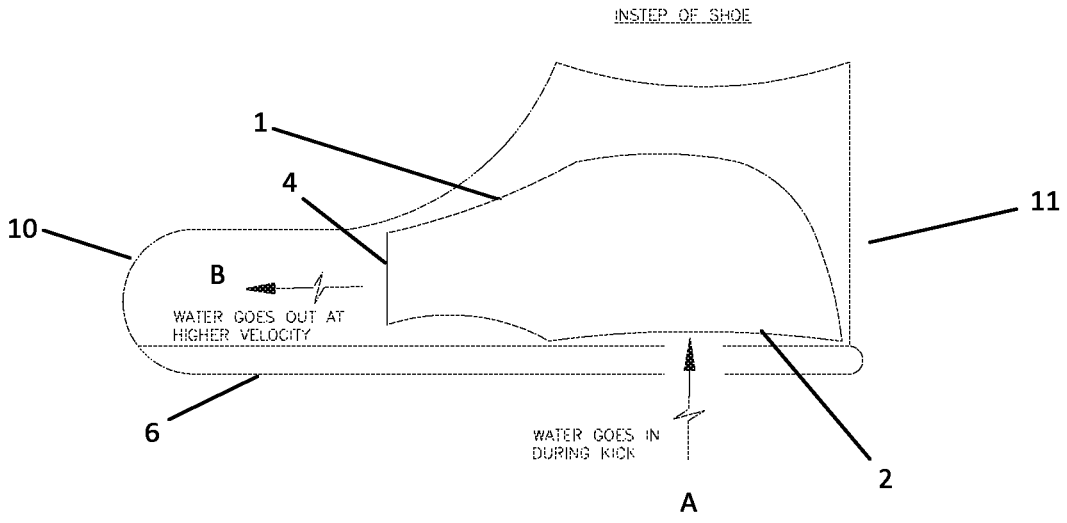
FIG. 5 is a view illustrating the instep of a nozzle shoe according to an exemplary embodiment of the present general inventive concept.
Figure 7:
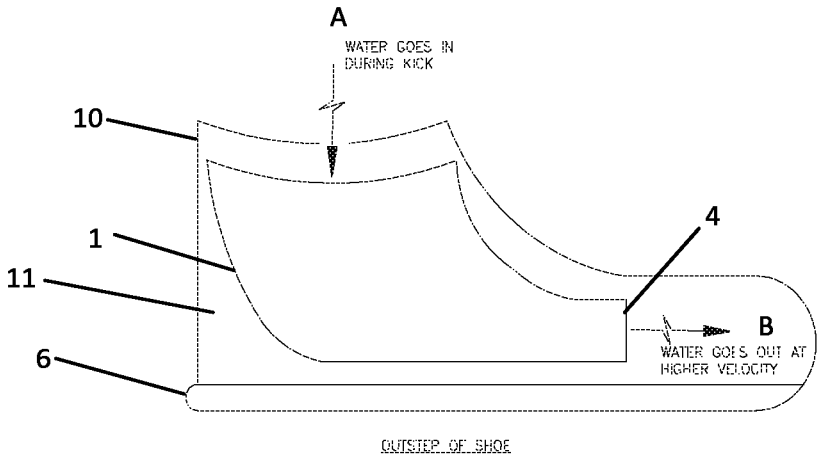
FIG. 7 is a view illustrating the outstep of a nozzle shoe according to an exemplary embodiment of the present general inventive concept.

As illustrated in FIGS. 5 and 7, the nozzles 1 may be attached at an ankle portion 11 of the nozzle shoe 10, the ankle portion 11 corresponding to a location of a wearer's ankle. However, the nozzles 1 may be configured in any manner that directs the flow of water to propel a wearer during a kicking motion of the wearer. In the exemplary embodiments illustrated in FIGS. 12-14, for example, two nozzles 1 extend from the top of the shoe 10 to either side thereof. Alternatively, the two nozzles 1 illustrated in FIGS. 12-14 could be a single nozzle 1, having two inlets 2 and two outlets 4. The configuration illustrated in FIGS. 12-14 can provide substantial surface area to move water.

The nozzles 1 may be made of a material such as rubber which is light and non-reactive to water, but also rigid enough to prevent deformation under extreme pressure. The nozzles 1 may be designed to have a large inlet area, which may be divided over multiple inlets 2 in which water will be directed during a kicking motion of the wearer. The shoe 10 can also be made of a variety of materials suited to being immersed in water, for example neoprene or mesh.

As the water enters the one or more inlets 2 of each nozzle 1, it is directed to one or more outlets 4 of the nozzle 1. A flow direction of the water is changed in the nozzles 1, from an intake direction A into the one or more inlets 2, to an output direction B out the outlet(s) 4, as illustrated for example in FIGS. 5, 7, 10, and 13. Each nozzle 1 may include a bend 7 to change the flow direction of the water in this manner. Each nozzle 1 may optionally include internal turning vanes 3, which may aid in keeping the water in a substantially laminar condition in which the water travels in a uniform direction, as opposed to a turbulent condition which is less orderly. Maintaining a substantially laminar flow to the water passing through the nozzle 1 thereby achieves a more efficient performance while the water is within the nozzles 1. However, these turning vanes 3 are not necessarily included in each nozzle 1. For example, a nozzle shoe 10 according to an exemplary embodiment of the present general inventive concept may include one or more nozzles 1 that include vanes 3, and one or more nozzles 1 that do not includes vanes 3. In an alternative example, all or none of the one or more nozzles 1 mounted to the nozzle shoe 10 may include the vanes 3.

Figure 6:
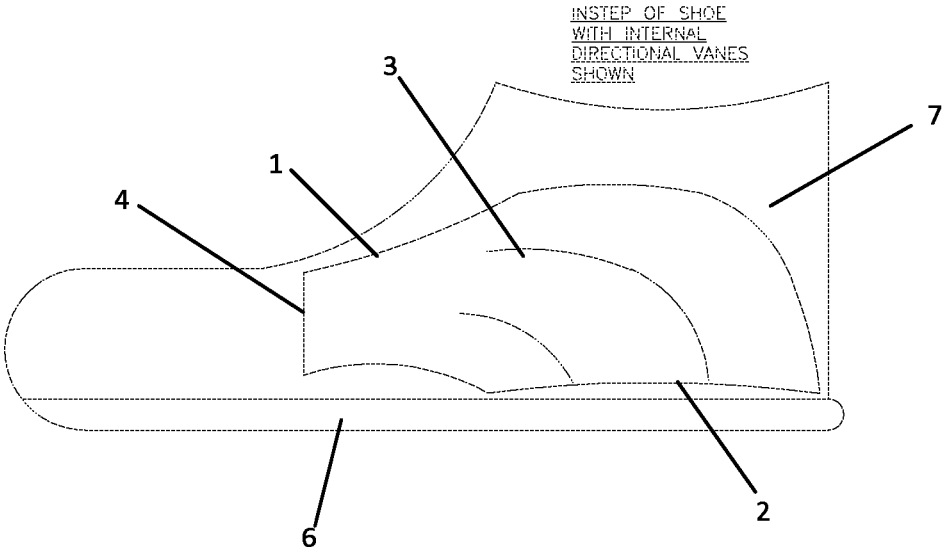
FIG. 6 is a view illustrating the direction of internal directional vanes of the nozzle shoe illustrated in FIG. 5.
Figure 8:
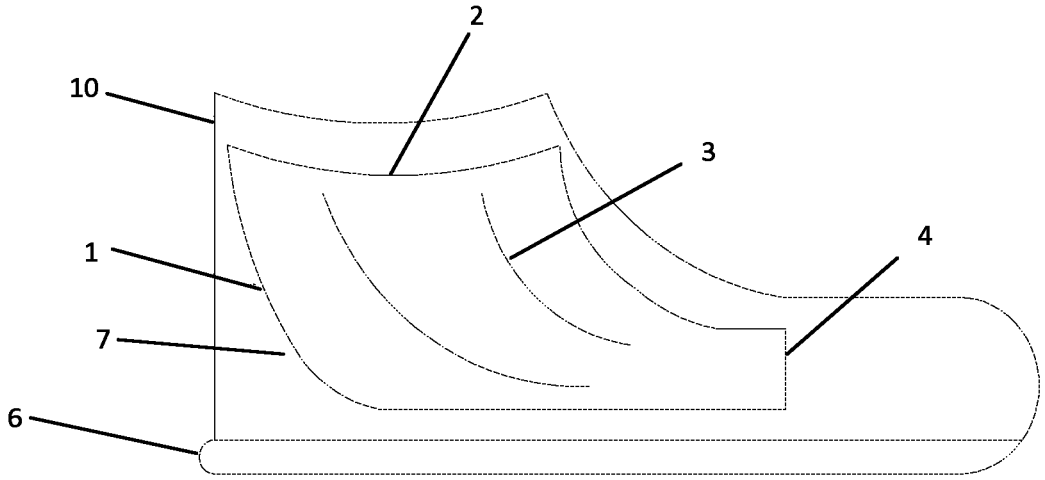
FIG. 8 is a view illustrating the direction of the internal directional vanes of the nozzle shoe illustrated in FIG. 6.
Figure 9:
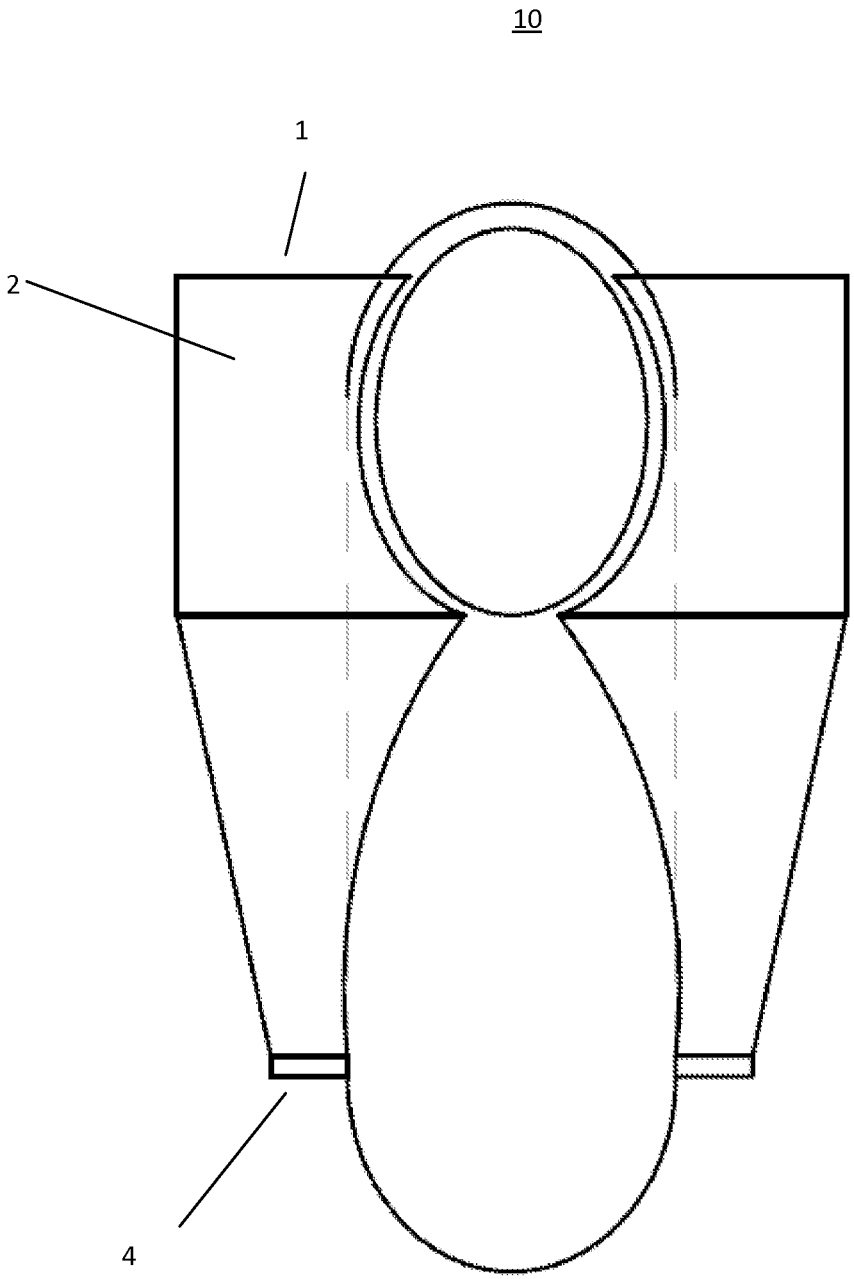
FIG. 9 is a top view illustrating a nozzle shoe according to an exemplary embodiment of the present general inventive concept.

As illustrated for example in FIGS. 6 and 8, the area of the one or more outlets 4 of each nozzle 1 may be smaller than the total area of the one or more inlets 2. This reduction in area between the one or more inlets 2 and the one or more outlets 4 may provide a proportionally higher force out the outlet 4 which will assist in propelling a wearer of the nozzle shoe 10 through the water at a higher velocity. The exact configuration of the one or more inlets 2 and one or more outlets 4 depends on the particular exemplary embodiment, however. For example, the area of the one or more inlets 2 may be the same size as that of the outlet(s) 4 of the nozzle 1.

The configuration of the nozzles 1 can also depend on the size of the shoe 10 itself. For example, a high shoe may include a longer nozzle 1, with correspondingly larger one or more inlets 2. See for example FIGS. 9-11.

It will be understood that the nozzles 1 in the exemplary embodiments of the present general inventive concept illustrated in FIGS. 9-14 may be similar in configuration to those illustrated in FIGS. 1-8, e.g, the nozzles 1 may also include or not include the vanes 3 and/or the bend 7 illustrated in FIGS. 6 and 8.

During a kicking motion of the wearer, water enters the one or more nozzles 1 of the nozzle shoe 10 through the one or more inlets 2 of each nozzle 1, traveling in the intake direction A. Water is directed out the outlet(s) 4, in the output direction B. The water exiting the outlet(s) 4 exerts a force which propels the wearer through the water during the kicking motion.

Since the one or more nozzles 1 provide forward motion as described above, the nozzle shoe 10 does not require fins to propel the wearer through the water. As a result, the nozzle shoe 10 may be worn on dry land without encumbering or restricting the wearer's movement.

Figure 10:
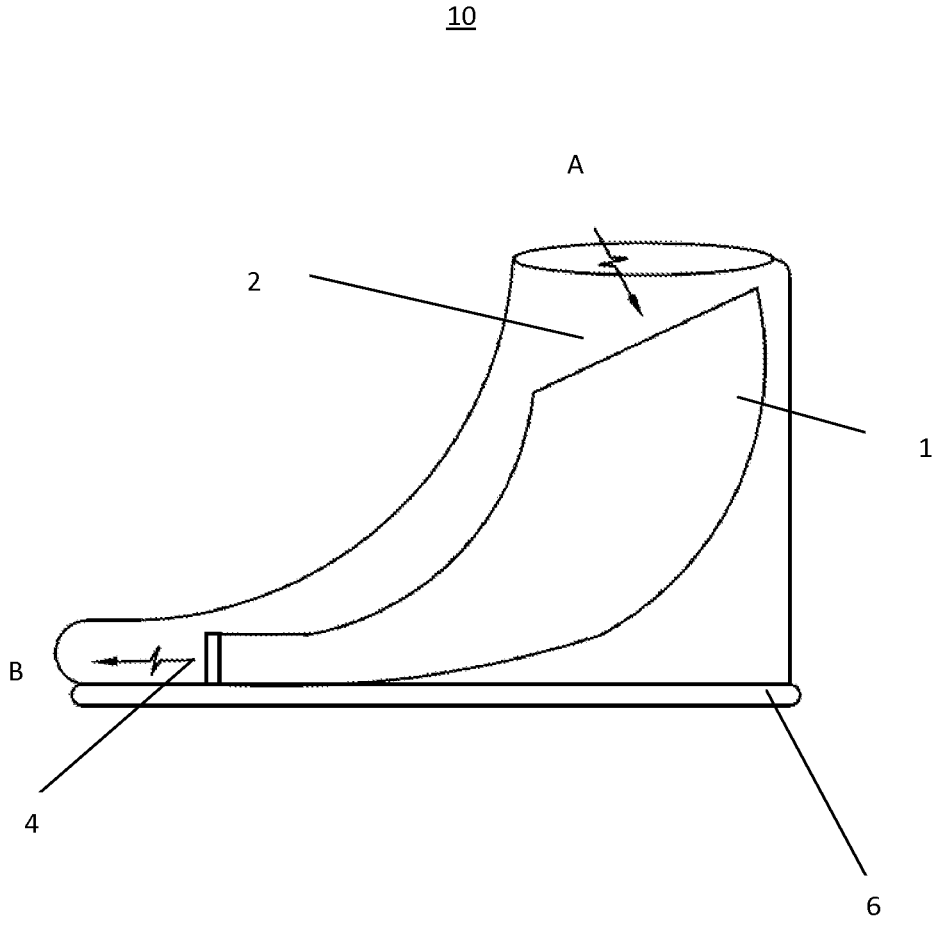
FIG. 10 is a side view illustrating a nozzle shoe according to an exemplary embodiment of the present general inventive concept.
Figure 11:
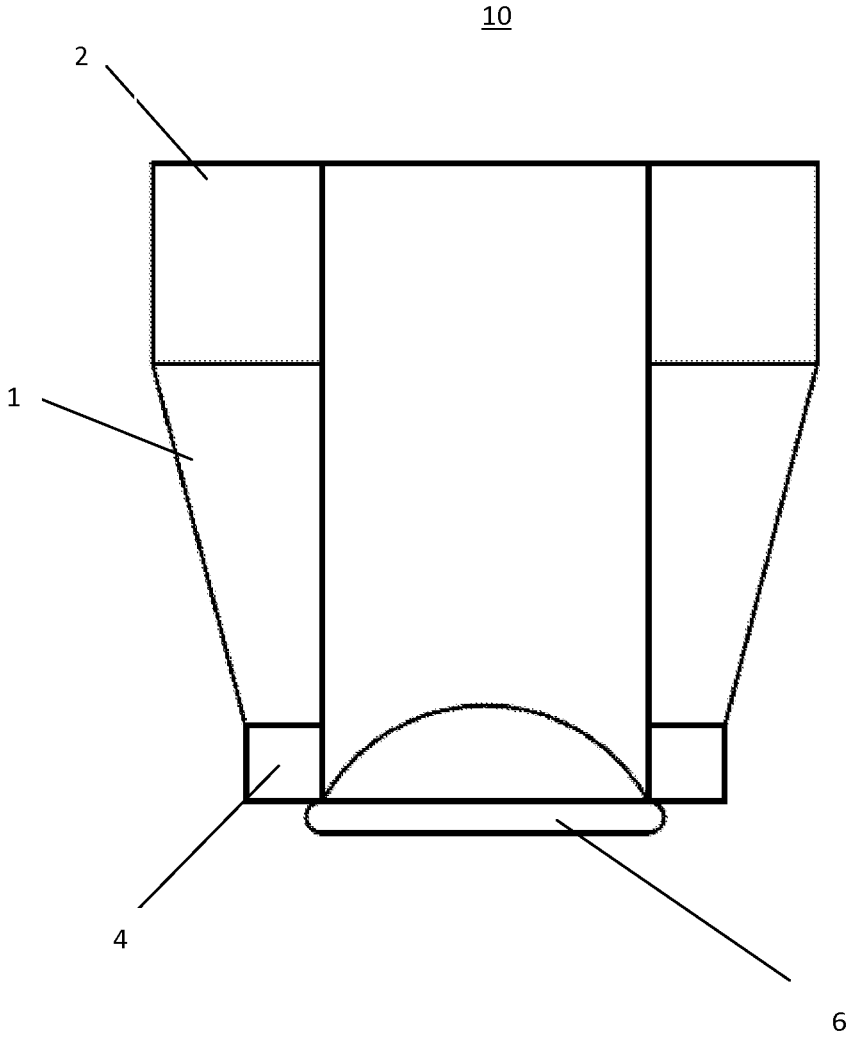
FIG. 11 is a front view illustrating a nozzle shoe according to an exemplary embodiment of the present general inventive concept.
Figure 12:
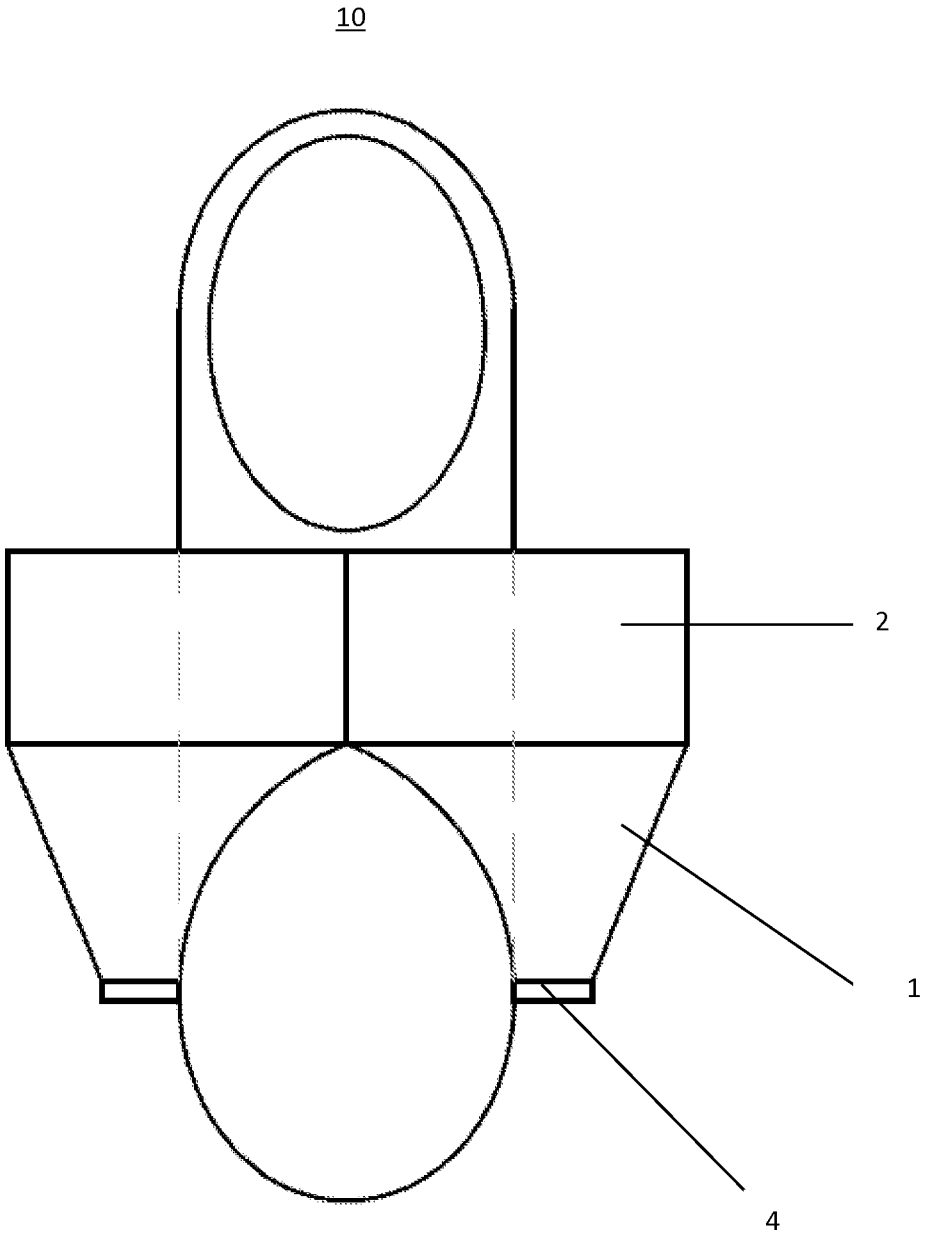
FIG. 12 is a top view illustrating a nozzle shoe according to an exemplary embodiment of the present general inventive concept.
Figure 13:
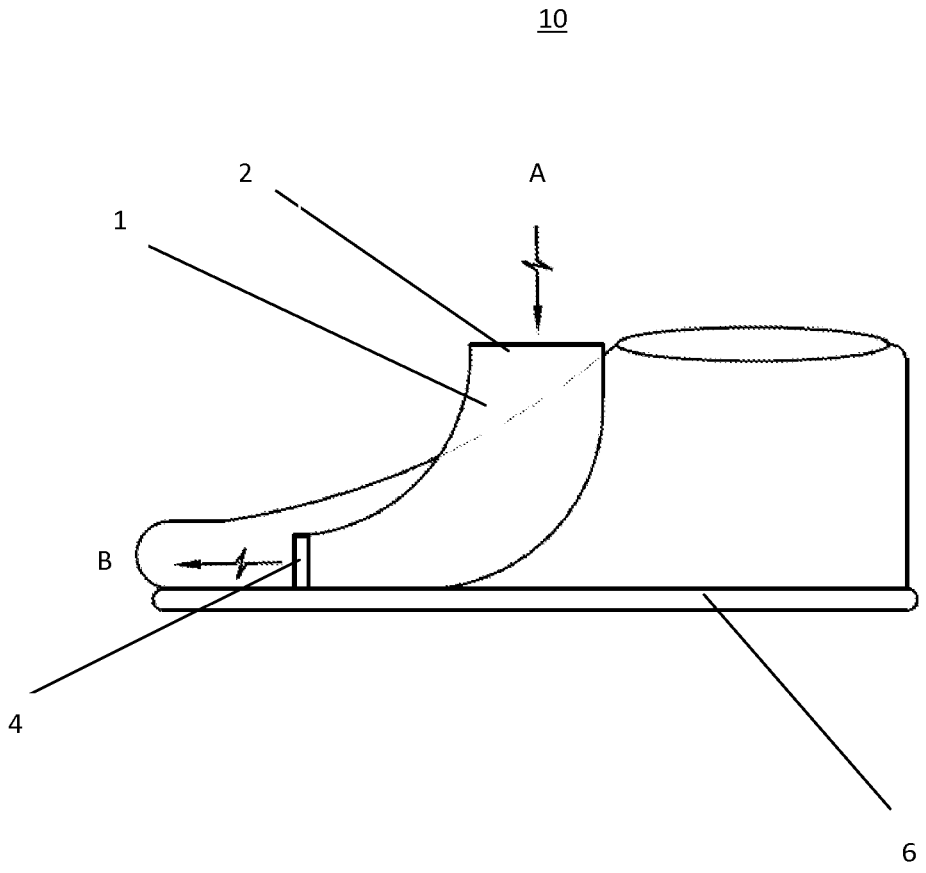
FIG. 13 is a side view illustrating a nozzle shoe according to an exemplary embodiment of the present general inventive concept.
Figure 14:
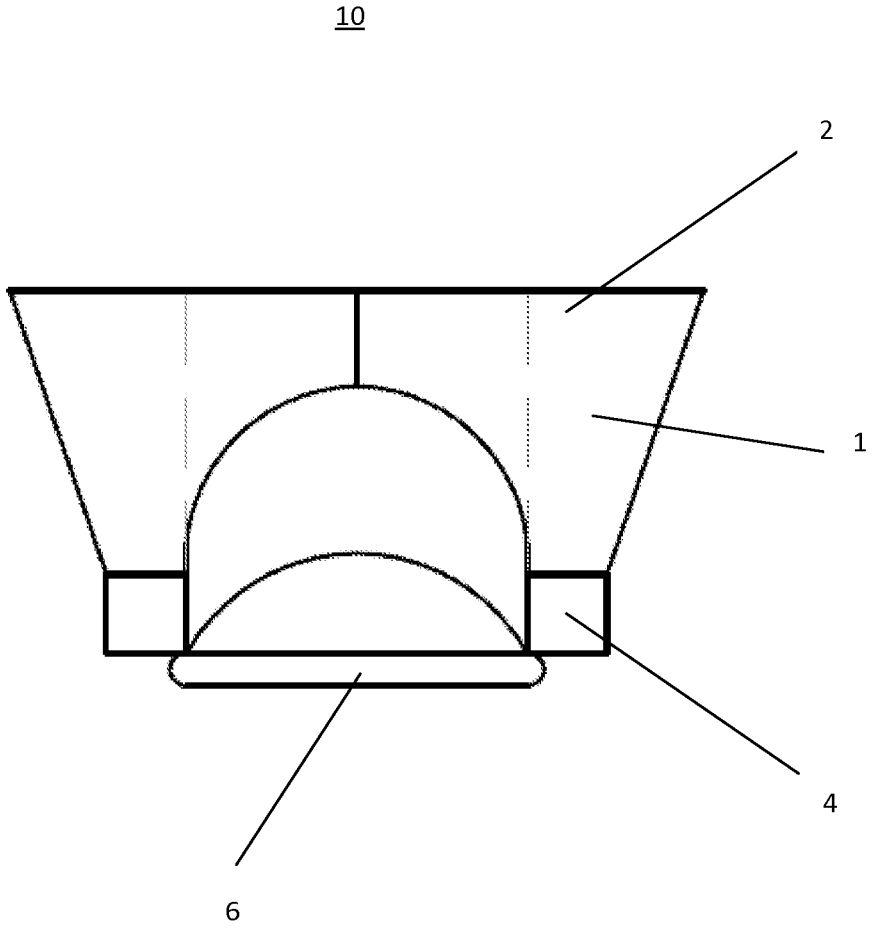
FIG. 14 is a front view illustrating a nozzle shoe according to an exemplary embodiment of the present general inventive concept.

As illustrated in the exemplary embodiments of the present general inventive concept illustrated in the Figures, the one or more inlets 2 of the nozzles 1 may be oriented in different directions depending on which side of the nozzle shoe 10 the nozzle 1 is mounted on. As illustrated in FIGS. 5 and 7, the one or more inlets 2 of the nozzle 1 on the instep of the nozzle shoe 10 (corresponding to the left side of a right shoe and the right side of a left shoe) are directed downwards towards a sole 6, while the one or more inlets 2 of the nozzle 1 on the other side of the nozzle shoe 10 are directed upwards. This configuration of the nozzles 1 is to correspond to the directions of a kicking motion of a wearer. However, it will be understood that the orientation of the one or more inlets 2 can be set to any orientation in which water will be drawn into the one or more inlets 2 during a kicking motion. For example, in a shoe 10 comprising two or more nozzles 1, the one or more inlets 2 of each nozzle 1 may be oriented in the same direction. As further illustrated in the exemplary embodiment of FIGS. 9-11, the one or more nozzles 1 may extend over an upper portion of the shoe 10, thereby increasing the overall cross-sectional area of the one or more inlets 2. Still further, the orientation of the one or more inlets 2 and one or more outlets 4 of each nozzle 1 may be adjusted according to the specific configuration of the nozzle 1. For example, as illustrated in FIG. 10, the one or more inlets 2 may be at an angle to, e.g., the sole 6 of the shoe 10. Varying the configuration of the nozzle 1 in this manner allows the nozzle 1 to be tailored to a specific use, for example the kicking motion used while swimming in a high-top shoe, in which the one or more inlets 2 may be positioned on a user's leg instead of the user's foot (see for example FIGS. 9-11).

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A shoe, comprising:

one or more nozzles, each of the one or more nozzles being mounted to an ankle portion of the shoe, the ankle portion corresponding to a location of the wearer's ankle, each of the one or more nozzles comprising:

one or more inlets to take in fluid traveling in an intake direction during a kicking motion of a wearer;

a bend to change a flow direction of the fluid from the intake direction to an output direction; and one or more outlets to expel fluid in the output direction.

2. The shoe of claim 1, wherein one or more of the nozzles further comprise:

at least one internal vane comprising the bend to change the flow direction of the fluid from the intake direction to the output direction.

3. The shoe of claim 2, wherein a direction of the at least one internal vane is preset according to the kicking motion.

4. The shoe of claim 3, wherein the at least one internal vane maintains the fluid in a substantially laminar condition as the fluid is moved from the one or more inlets to the one or more outlets.

5. The shoe of claim 1, wherein the one or more outlets have a smaller area than the one or more inlets.

6. The shoe of claim 1, wherein at least one of the one or more nozzles is mounted on a first side of the shoe, and at least one of the one or more nozzles is mounted on a second side of the shoe opposite the first side.

7. The shoe of claim 6, wherein the one or more inlets of the at least one nozzle mounted on the first side of the shoe is oriented in a first direction, and wherein the one or more inlets of the at least one nozzle mounted on the second side of the shoe is oriented in a second direction different from the first direction.

8. The shoe of claim 7, wherein:

the first direction and the second direction are opposite to each other.

9. The shoe of claim 6, wherein the inlets of the nozzles mounted on the first and second sides of the shoe are oriented in the same direction.

10. The shoe of claim 1, further comprising:

a sole, wherein the one or more inlets face towards the sole.

11. The shoe of claim 1, further comprising:

a sole, wherein the one or more inlets face away from the sole.

12. The shoe of claim 1, wherein each of the one or more inlets is formed at a predetermined angle to a sole of the shoe.

13. The shoe of claim 12, wherein the predetermined angle is determined by a height of the shoe.

14. The shoe of claim 1, wherein at least one nozzle is disposed on one side of the shoe.

15. The shoe of claim 1, wherein the at least one nozzle is disposed on opposing sides of the shoe.

* * * * *